US011532203B2

(12) United States Patent
Feng et al.

(10) Patent No.: US 11,532,203 B2
(45) **Date of Patent: *Dec. 20, 2022**

(54) GAMING SYSTEM HAVING ELECTRONIC GAMING MACHINE AND MULTI-PURPOSE ISOLATING ENCLOSURE

(71) Applicant: IGT, Las Vegas, NV (US)

(72) Inventors: Wopei Feng, Beijing (CN); Xuan Liu, Beijing (CN); Mo Fang, Beijing (CN); Yongqiang Jin, Beijing (CN)

(73) Assignee: IGT, Las Vegas, NV (US)

( * ) Notice: Subject to any disclaimer, the term of this patent is extended or adjusted under 35 U.S.C. 154(b) by 106 days.

This patent is subject to a terminal disclaimer.

(21) Appl. No.: 17/079,771

(22) Filed: Oct. 26, 2020

(65) Prior Publication Data

US 2021/0110644 A1 Apr. 15, 2021

Related U.S. Application Data

(63) Continuation of application No. 16/298,411, filed on Mar. 11, 2019, now Pat. No. 10,825,287.

(51) Int. Cl.
*G07F 17/32* (2006.01)
*G10K 11/178* (2006.01)

(52) U.S. Cl.
CPC ..... *G07F 17/3216* (2013.01); *G07F 17/3204* (2013.01); *G10K 11/178* (2013.01)

(58) Field of Classification Search
CPC ..... G07F 17/3216; G07F 17/3204; G10K 11/178
USPC ..... 463/46
See application file for complete search history.

(56) References Cited

U.S. PATENT DOCUMENTS

| | | | | |
|---|---|---|---|---|
| 4,695,903 | A | 9/1987 | Serap et al. | |
| 5,344,199 | A | 9/1994 | Carstens et al. | |
| D370,535 | S | 6/1996 | Karamesines | |
| 5,775,987 | A * | 7/1998 | Brinket | B08B 15/007 454/341 |
| 6,641,139 | B2 | 11/2003 | Lamberti et al. | |
| 10,167,644 | B1 | 1/2019 | Aliev | |
| 2003/0114214 | A1* | 6/2003 | Barahona | G07F 17/32 463/20 |
| 2003/0123688 | A1 | 7/2003 | Cox et al. | |
| 2006/0014586 | A1 | 1/2006 | Gatto et al. | |
| 2007/0186490 | A1 | 8/2007 | Salemi | |
| 2009/0209342 | A1 | 8/2009 | Okada | |
| 2014/0100030 | A1 | 4/2014 | Burke et al. | |
| 2014/0350924 | A1 | 11/2014 | Zurek et al. | |
| 2015/0091712 | A1 | 4/2015 | Poornachandran et al. | |
| 2018/0350190 | A1* | 12/2018 | Wen | G06F 1/20 |

(Continued)

OTHER PUBLICATIONS

"Elite Hollywood Sky's the Limit Cash Cube Money Machine brochure", Fun Industries Inc., www.funindustries.com, copyright 2004 (13 pages).

(Continued)

*Primary Examiner* — Jay Trent Liddle
*Assistant Examiner* — Ryan Hsu
(74) *Attorney, Agent, or Firm* — Neal, Gerber & Eisenberg LLP

(57) ABSTRACT

A gaming system including an isolating partially see through sound blocking multi-function isolating enclosure and an electronic gaming machine positioned in the enclosure.

14 Claims, 7 Drawing Sheets

(56) References Cited

U.S. PATENT DOCUMENTS

| | | | | |
|---|---|---|---|---|
| 2019/0177993 | A1* | 6/2019 | Shell | E04H 1/125 |
| 2020/0018060 | A1* | 1/2020 | Watanabe | E04H 1/1205 |

OTHER PUBLICATIONS

"Garden Games cash machine", https://www.gardengameshireuk.com/category/interactive-games-hire/112/grab-a-grand-cash-cube-booth-hire#BodyContent, Available prior to Mar. 11, 2019 (1 pages).
"MEGACUBE Brochure", Fund Industries Inc., www.funindustries.com/megacubebrochure.htm, copyright 2008 (2 pages).

* cited by examiner

1000

GAMING SYSTEM HAVING ELECTRONIC GAMING MACHINE AND MULTI-PURPOSE ISOLATING ENCLOSURE

PRIORITY CLAIM

This patent application is a continuation of, claims priority to and the benefit of U.S. patent application Ser. No. 16/298,411, filed on Mar. 11, 2019, now U.S. Pat. No. 10,825,287, the entire contents of which is incorporated by reference herein.

BACKGROUND

The present disclosure relates to gaming systems including gaming machines that enable players to make wagers. Gaming machines may be placed in casinos. Casinos may have relatively high levels of noise due to the various different sounds made by a large quantity of gaming machines in such casinos, the people in such casinos, and the music or other noises provided by the casino.

BRIEF SUMMARY

Various embodiments of the present disclosure are directed to a gaming system including an electronic gaming machine and a multi-purpose isolating enclosure for the electronic gaming machine.

Various embodiments provide a gaming system including a partially transparent isolating enclosure and an electronic gaming machine. The enclosure includes a housing including an access door and defining an interior space, wherein the housing configured to block sound waves from entering the interior space. The electronic gaming machine includes a housing at least partially positionable in the interior space of the isolating enclosure. The electronic gaming machine includes a display device, a sound producing device, a processor, and a memory device that stores a plurality of instructions. The gaming system further includes a sound detecting device supported by one of the housing of the isolating enclosure and the housing of the electronic gaming machine. The plurality instructions, when executed by the processor, cause the processor to, for a play of a game: responsive to a prompt by the electronic gaming machine and the sound detecting device receiving a sound from a player in the isolating enclosure, determine a decibel level of the sound, responsive to the determined decibel level being above a first decibel level threshold, cause a first action to occur in the play of the game, and responsive to the determined decibel level being below the first decibel level threshold, cause a second action to occur in the play of the game, the second action being different than the first action.

Various other embodiments provide a gaming system including a partially transparent isolating enclosure and an electronic gaming machine. The isolating enclosure includes a housing, a ventilation system connected to the housing, a communication system connected to the housing, and a lighting system connected to the housing. The housing includes a base, a front wall, a first side wall, a back wall, a second side wall, a top, a plurality of upright supports, and an access door, wherein the front wall, the first side wall, and the second side wall are partially transparent. The housing defines an interior space and is configured to block sound waves from entering the interior space. The electronic gaming machine includes a housing at least partially positionable in the interior space of the isolating enclosure. The electronic gaming machine includes a display device, a sound producing device, a sound detecting device, a processor, and a memory device that stores a plurality of instructions, which when executed by the processor, cause the processor to, for a play of a game: display, via the display device, a prompt during the play of the game for a player to make sounds, responsive to the sound detecting device receiving the sounds from the player in the isolating enclosure in response to the prompt, determine a characteristic of the sounds, determine a first award responsive to the sounds having a first characteristic, determine a second award responsive to the sounds having a second characteristic, the first characteristic being different from the second characteristic and the first award being different than the second award, and display the determined award.

Various other embodiments provide a method of operating a gaming system. The method includes: determining, via a microphone and a processor, a decibel level of a sound made by a player in an interior area of a substantially transparent sound isolating enclosure in response to a prompt by an electronic gaming machine in the isolating enclosure, responsive to the decibel level being above a first decibel level threshold, causing a display device of the electronic gaming machine to display a first action in a play of the game displayed by the display device of the electronic gaming machine, and responsive to the decibel level being below the first decibel level threshold, causing the display device to display a second action in the play of the game displayed by the display device of the electronic gaming machine, the second action being different than the first action.

Additional features are described herein, and will be apparent from, the following Detailed Description and the Figures.

BRIEF DESCRIPTION OF SEVERAL OF THE DRAWING

DETAILED DESCRIPTION

Figure 1:
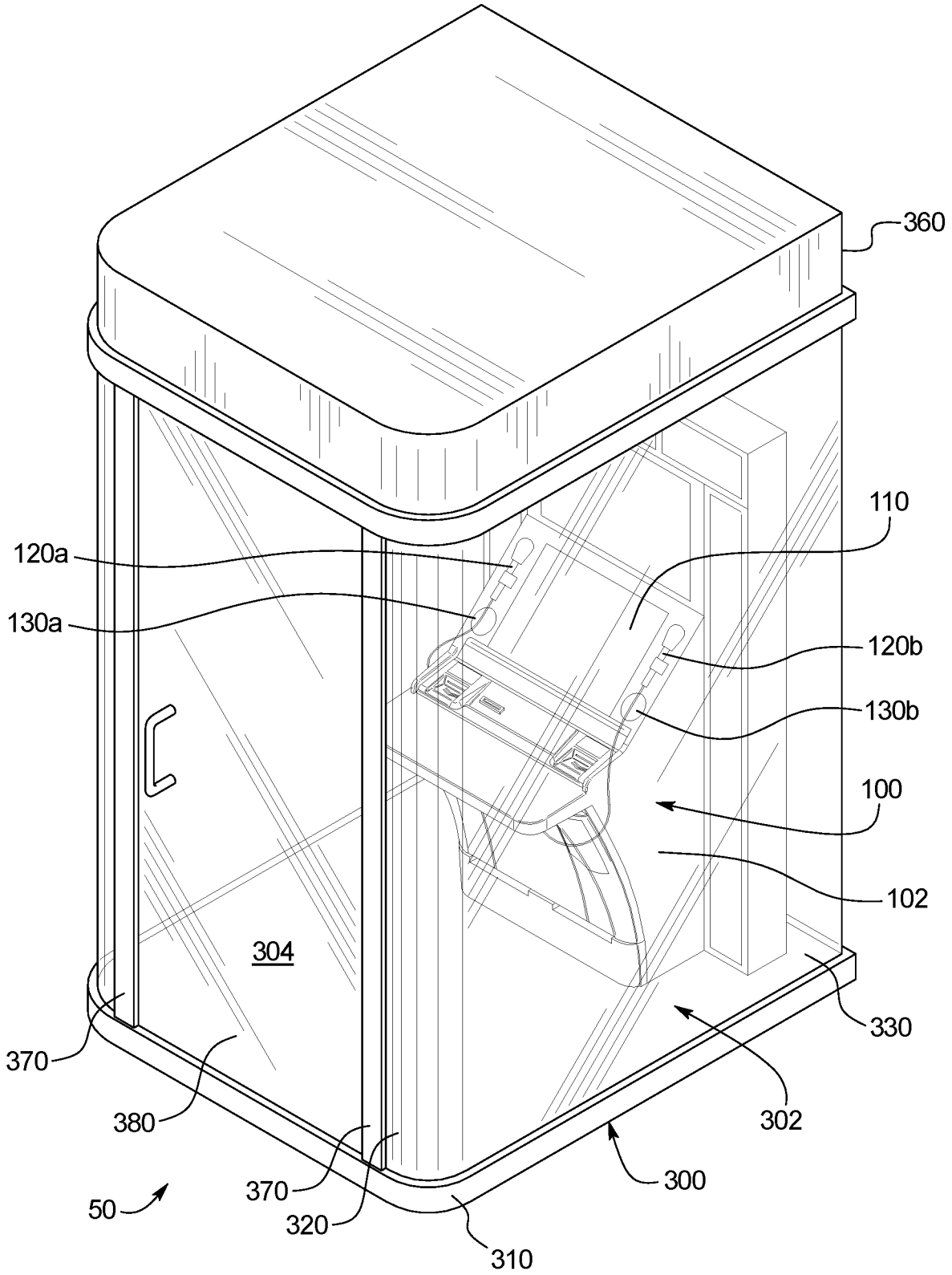
FIG. 1 is a front perspective view of an electronic gaming machine and a multi-purpose isolating enclosure of one example embodiment of the present disclosure.
Figure 2:
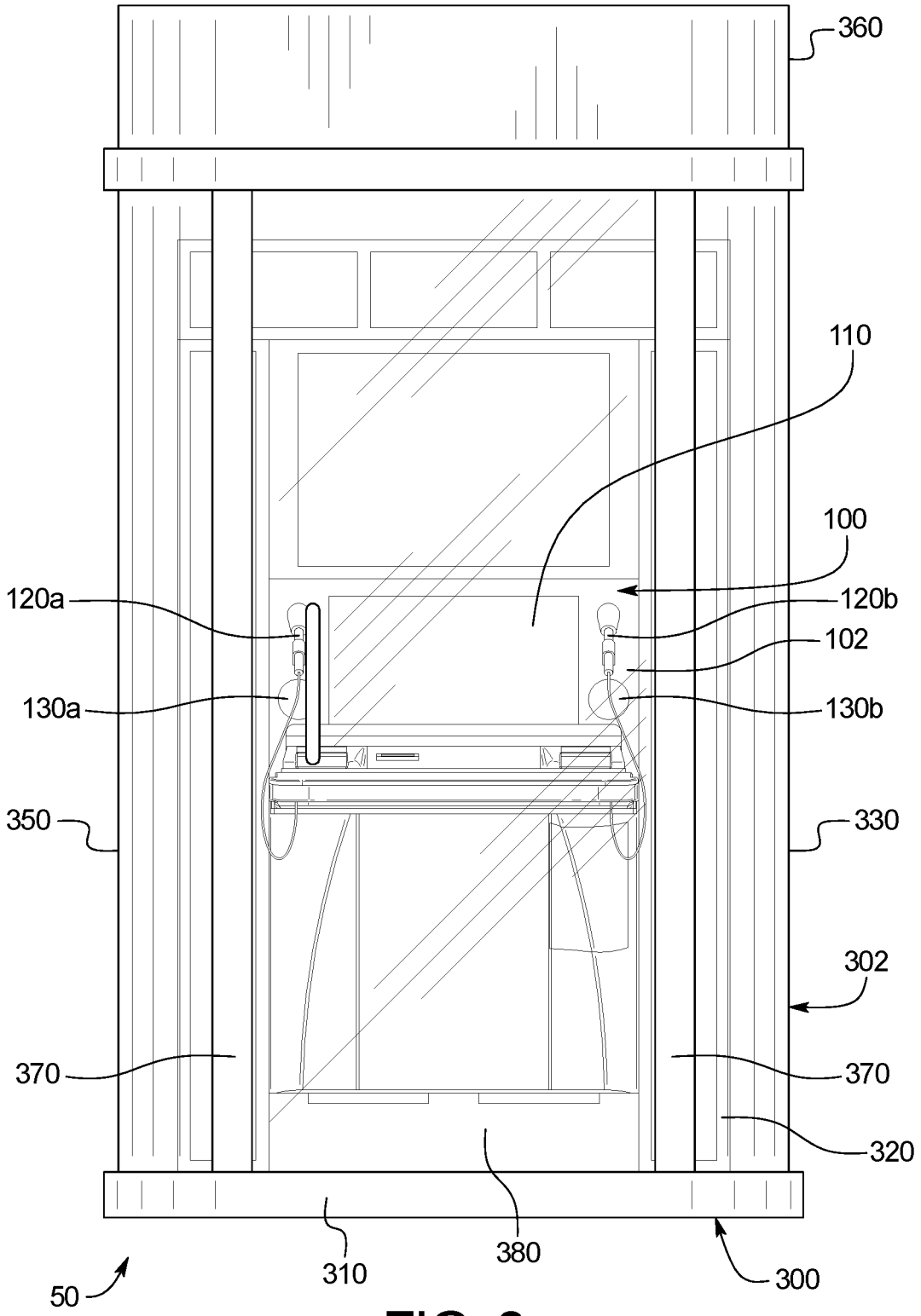
FIG. 2 is a front view of the electronic gaming machine and the multi-purpose isolating enclosure of FIG. 1.
Figure 3:
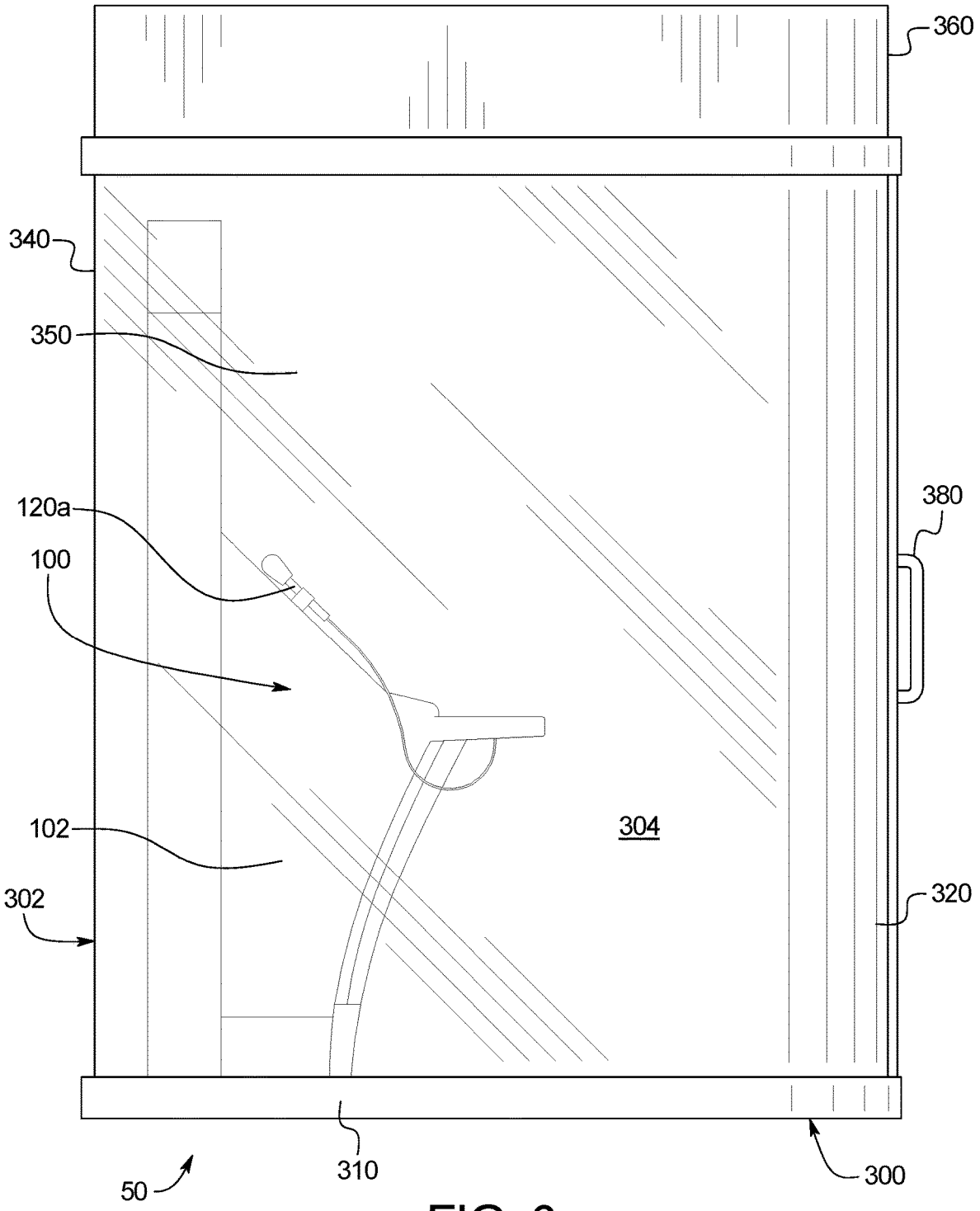
FIG. 3 is a left side view of the electronic gaming machine and the multi-purpose isolating enclosure of FIG. 1.
Figure 4:
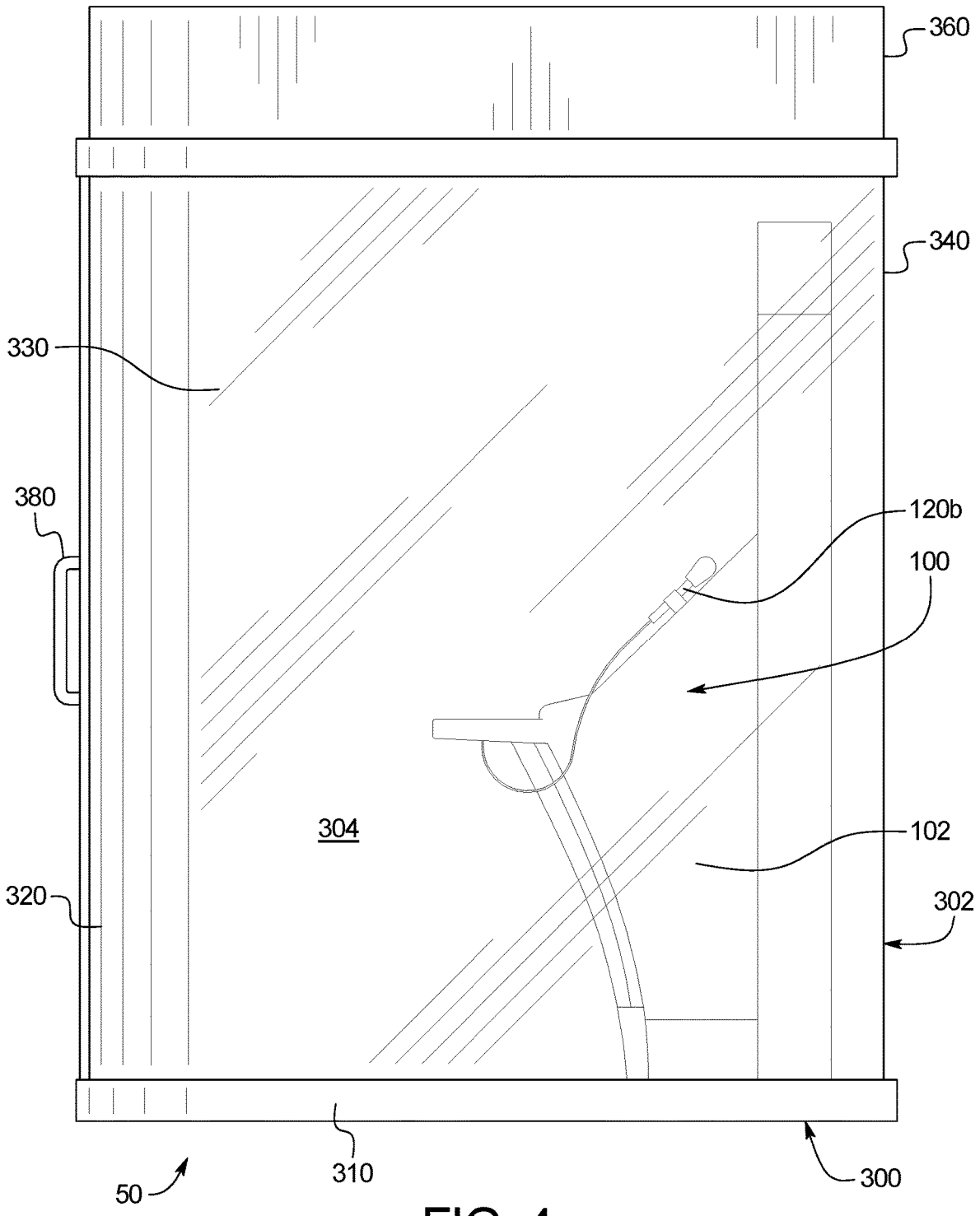
FIG. 4 is a right view of the electronic gaming machine and the multi-purpose isolating enclosure of FIG. 1.
Figure 5:
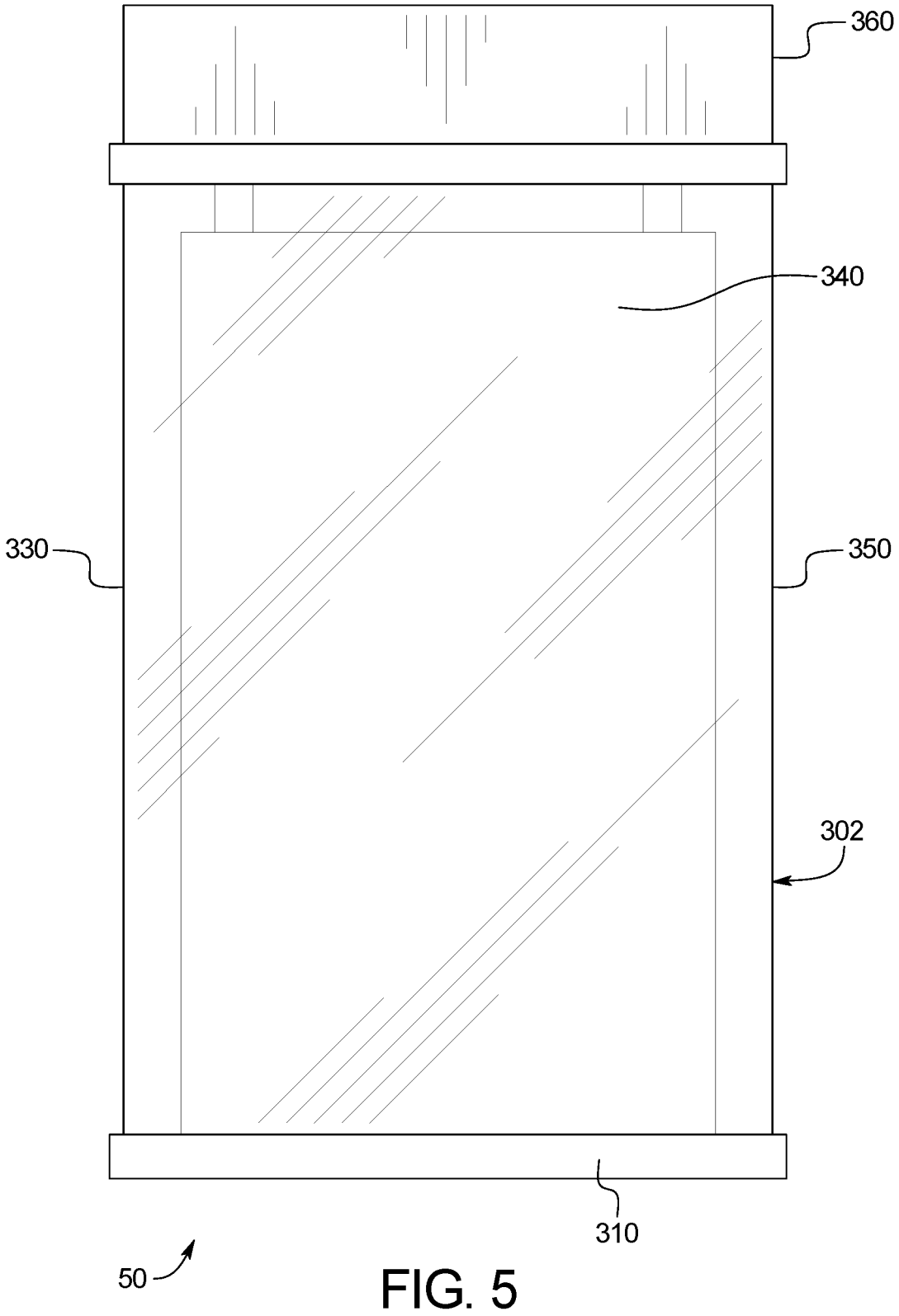
FIG. 5 is a back view of the electronic gaming machine and the multi-purpose isolating enclosure of FIG. 1.

Various embodiments of the present disclosure are directed to a gaming system including an electronic gaming machine ("EGM") and a multi-purpose isolating enclosure. For brevity, and unless specifically stated otherwise, the term "EGM" is used herein to refer to an electronic gaming machine (such as but not limited to a slot machine, a video poker machine, a video lottery terminal, a terminal associated with an electronic table game, a video keno machine, a video bingo machine, a sports betting terminal, or a kiosk such as a sports betting kiosk). For brevity, and unless specifically stated otherwise, the term "enclosure" is sometimes used herein to refer to the multi-purpose isolating enclosure.

Referring now to FIGS. 1, 2, 3, 4, and 5, one example embodiment of a gaming system including an example EGM 100 and an example multi-purpose isolating enclosure 300 of the present disclosure is illustrated and generally indicated by numeral 50.

This example EGM 100 includes a suitable housing 102 that supports numerous components of the EGM 100. It should be appreciated that only certain of these components are illustrated and described herein, and that one of ordinary skill in the art would understand the various components not illustrated or described herein.

In this illustrated example embodiment, the EGM 100 includes one or more display devices such as display device 110 supported by the housing 102, one or more sound input devices such as microphones 120*a* and 120*b* supportable by and connected to the housing 102, and one or more sound producing devices such as one speakers 130*a* and 130*b* supported by the housing 102. In this illustrated example embodiment, the microphones 120*a* and 120*b* are supported by suitable brackets (not labeled) connected to the housing 102 and connected to the housing 102 by suitable electrical cords (not labeled). It should be appreciated that in other embodiments, the microphones are wireless and configured to communicate with the EGM 100. It should be appreciated that the quantity of input devices and display devices of the EGM 100 may vary in accordance with the present disclosure. It should be also be appreciated that the relative positions of the input devices and display devices of the EGM 100 may vary in accordance with the present disclosure. In this illustrated example embodiment, the EGM 100 further includes a processor (not shown in FIGS. 1 to 5), and a memory device (not shown in FIGS. 1 to 5) that stores a plurality of instructions, which when executed by the processor, causes the processor to operate with the display device 110, the microphones 120*a* and 120*b*, and the speakers 130*a* and 130*b* to provide the various example functionality of the EGM 100 described herein. The display device may be any of the display devices described below, the processor may be any of the processors described below, and the memory device may be any of the memory devices described below.

It should also be appreciated that the EGM 100 can include one or more sound cards (not shown) or other suitable hardware and/or software components (not shown) configured to measure and/or interpret the sounds made by players using the microphones 120*a* and 120*b*. For example, the EGM 100 including the processor(s), microphone(s), and other components of the EGM 100 can be configured to determine the decibel level(s) of the sound(s) made by a player using one of the microphones.

This example enclosure 300 includes: (1) a substantially see through housing 302; (2) one or more ventilation systems (not shown or labeled) connected to the housing 302; (3) one or more communication systems (not shown or labeled) connected to the housing 302; and (4) one or more lighting systems (not shown or labeled) connected to the housing 302. This example housing 302 defines an interior area 304 in which the EGM 100 is positioned. The interior area 304 of the enclosure 300 can be sized and configured such that one or more EGMs (such as EGM 100) can be positioned in the enclosure 300 in accordance with the present disclosure. This example enclosure 300 also provides a suitable amount of space for one or two people (such as two players, or a player and a observer). The enclosure 300 can be sized and configured to provide space for more than two people in accordance with the present disclosure. The interior area 304 of the enclosure 300 also provides a suitable amount of space for one or two chairs (not shown) such as for one or two people. The enclosure 300 can be sized and configured to provide space for more than two chairs in accordance with the present disclosure. In certain embodiments, the chairs are independent of the operation of the EGM 100 in the enclosure 300 and not connected (physically, electronically or communicatively) to the EGM 100 in the enclosure 300. In other embodiments, one or more of the chairs are connected (physically, electronically, and/or communicatively) to the EGM 100 in the enclosure 300.

For this illustrated example enclosure 300, the housing 302 includes: (1) a base 310; (2) a front wall 320; (3) a first side wall 330; (4) a back wall 340; (5) a second side wall 350; and (6) a top 360; (7) a plurality of upright supports 370; and (8) an access door 380 for access to the interior area 304 defined by the enclosure 300, all suitably connected. In this example housing, the front wall 320, the first side wall 330, the back wall 340, and the second side wall 350 are substantially transparent to enable people outside the enclosure 300 to see though those walls into the enclosure 320 as well as to enable people inside of the enclosure 300 to see through those walls to the areas outside of the enclosure 300. In other embodiments, one or more of the walls of the enclosure is/are not substantially transparent (such as the back wall of the enclosure). In other embodiments, the EGM 100 is attached to or built into one of the walls of the enclosure 300 (such as the back wall of the enclosure 300). Thus, in various embodiments, one or more of the see through or transparent portions of the enclosure 300 can be made from a suitable glass, acrylic resin, or other suitable material that provides multi-way or bi-directional visibility into and out of the enclosure 300. In alternative embodiments, one or more of the front wall, the back wall, the first side wall, the second side wall, and the access door are single directional in that they allow people to see into the enclosure 300 but do not enable a person in the enclosure 300 to see out of the enclosure through that portion of the enclosure 300.

The access door 380 functions as part or all of the front wall 320 in this example EGM 100; but it should be appreciated that the access door can be part of either of the side walls in other embodiments. In various embodiments, the access door 380 can be closed but is not lockable (or configured to not be locked). In other words, the housing 302 is constructed to prevent the access of door 380 of the housing 302 of the enclosure 300 from being locked. This prevents a person from locking themselves in the enclosure 300. In various embodiments, the access door 380 can be locked and unlocked from the outside of the enclosure 300 but only unlocked from the inside. This prevents a person from locking themselves in the enclosure 300, but enables casino personal to control who enters the enclosure 300.

In the illustrated example embodiment, the entire housing 302 (including each of the base 310, the front wall 320, the first side wall 330, the back wall 340, the second side wall 350, the top 360, the plurality of upright supports 370, and the access door 380) functions as a partial sound barrier that reflects or absorbs sounds from outside the enclosure 300 (such as the various sounds in a casino environment in which the enclosure 300 is located) and thus provides a noise reduced interior area 304 of the enclosure 300.

In various other embodiments, the housing 302 of the enclosure 300 further includes one or more additional sound barriers (not shown) configured to reflect or absorb sound waves from outside of the enclosure 300. These additional sound barriers may, in certain embodiments, be connected to one or more of the base 310, the front wall 320, the first side wall 330, the back wall 340, the second side wall 350, the top 360, the plurality of upright supports 370, and/or the access door 380 of the housing 304. These additional sound barriers may, in certain embodiments, be built into to one or more of the base 310, the front wall 320, the first side wall 330, the back wall 340, the second side wall 350, the top 360, the plurality of upright supports 370, and/or the access door 380 of the housing 302.

In various embodiments, the enclosure 300 further includes one or more noise cancelling devices or anti-noise sound generators (not shown) connected to the housing 302 of the enclosure 300. These noise cancelling devices or anti-noise sound generators may, in certain embodiments, be connected to one or more of the base 310, the front wall 320, the first side wall 330, the back wall 340, the second side wall 350, the top 360, the plurality of upright supports 370, and/or the access door 380 of the housing 304.

It should further be appreciated that the enclosure 300 functions as a partial sound barrier that also reflects or absorbs sounds from inside the enclosure 300 (such as the various sounds of the EGM 100 and from one or more players in the enclosure 300), and thus provides a noise reduced exterior area outside of the enclosure 300.

This example enclosure 300 is configured for multiple purposes and functionality in association with an EGM 100. Certain of these purposes and functions are configured for operation independent of the EGM 100 that is in the enclosure 300. Certain of these purposes and functions are configured for operation of or with the EGM 100 in the enclosure 300. The following provide various examples of such purposes and functions.

In various embodiments, the enclosure 300 provides a noise reduced interior area 304 for one or more players. This enables each player in the enclosure 300 to be in a casino environment but subjected to substantially less noise than is usually present in a casino environment. More specifically, these noise reducing features enable the EGM 100 in the enclosure 300 to interact with players in new and different ways—such as by requesting that a player make loud sounds as part of a skill based game play of the EGM 100 or by requesting that a player sing a song as part of a play of a skill based game play of the EGM 100. The enclosure 300 facilitates this by blocking the sounds made outside the enclosure 300 from being picked up by the microphones 120*a* or 120*b* of the EGM 100 and thus enables the EGM 100 to use player voice or sound inputs in game play or otherwise (because such sounds will be less obstructed by other noises from the casino environment). The enclosure 300 also facilitates this by blocking the sounds made by each player in the enclosure 300 from exiting the enclosure 300. This eliminates the chance of bothering other people in the casino (such as players adjacent to the enclosure 300). This also facilitates each player in the enclosure 300 feeling less inhibited from making such sounds or singing (i.e., because no one else in the casino outside of the enclosure 300 will hear the sounds made by that player).

Thus, in various embodiments, the noise reduced area 304 of the enclosure 300 enables the EGM 100 to include one or more games or other player related features that are configured to receive and use sounds produced by the player in the enclosure 300. For example, as further described below, in various embodiments, the EGM 100 includes a game in which the player can make sounds in response to one or more prompts by the EGM 100. The EGM employs the sounds made by the player in or for the game as further described below.

For example, in various example embodiments, the EGM 100 includes a game which requests from the player one or more player sound inputs, and where the EGM 100 determines the decibel level(s) of the one or more of the sounds made by the player to fully or partially determine one or more actions and/or one or more awards in or related to a play of the game. In various example embodiments, the EGM 100 determines an amount of an action to occur in the play of the game directly based on the decibel level(s) of one or more of the sounds made by the player. In various other example embodiments, the EGM 100 determines an action to occur in the play of the game indirectly based on the decibel level(s) of one or more of the sounds made by the player. For example, the decibel level determines an action in the game that in turn (and thus indirectly) partially determines an amount of an award in the game for the player.

In one such example, the EGM 100 includes a game during which the EGM 100 prompts the player one or more times (by one or more images displayed by the display device 110 and/or by sounds emitted by the speakers 130*a* and 130*b*) to make one or more sounds that are picked up by one of the microphones 120*a* or 120*b* of the EGM 100. The EGM 100 determines the decibel level of such sounds and makes determinations for the game based on those determined decibel levels. For example, responsive to the decibel level being above a first decibel level threshold, the EGM 100 causes display device 110 to display a first action in a play of the game, and responsive to the decibel level being below the first decibel level threshold, the EGM 100 causes display device 110 to display a second different action in the play of the game. In one such example, the EGM 100 determines an action in the form of a speed of a character based on the decibel level of the sounds made by the player. In another such example, the EGM 100 determines an action in the form of a force of a jump of a character based on the decibel level of the sounds made by the player.

In various such embodiments, the EGM 100 causes the display device 110 of the EGM 100 to display an indication to the player that the decibel level of the sound made by the player will determine an action in the play of the game. In various such embodiments, the EGM 100 causes the display device 110 of the EGM 100 to display an indication to the player that multiple different decibel levels of the sound and multiple different actions in the play of the game.

Figure 6:
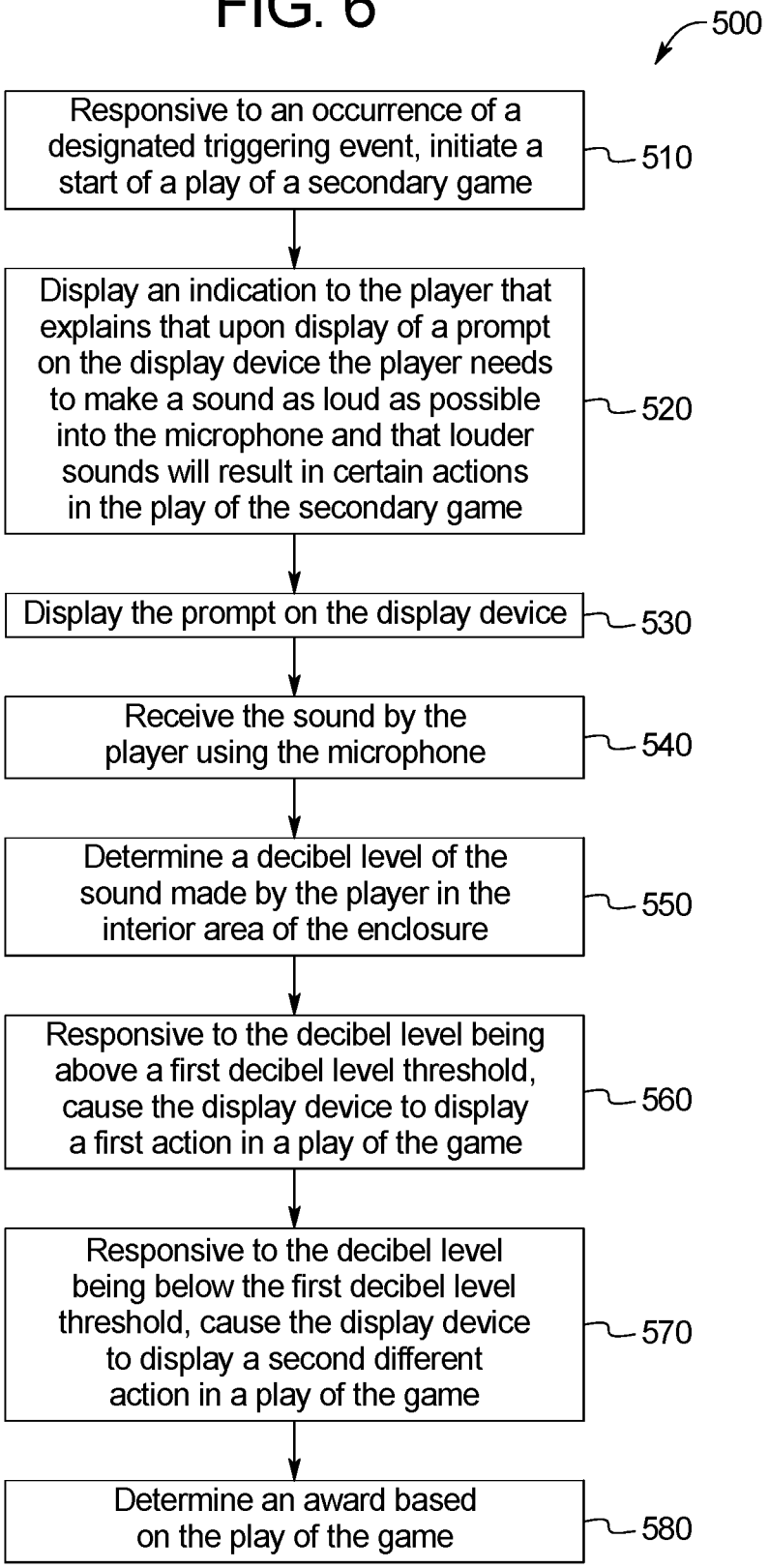
FIG. 6 is a flowchart of one example method of operation of the electronic gaming machine in the multi-purpose isolating enclosure of FIG. 1.

FIG. 6 is a flowchart of an example process or method 500 of operating an example gaming system of the present disclosure. In various embodiments, the process 500 is represented by a set of instructions stored in one or more memories and executed by one or more processors. Although the process 500 is described with reference to the flowchart shown in FIG. 6, many other processes of performing the acts associated with this illustrated process may be employed. For example, the order of certain of the illustrated blocks or diamonds may be changed, certain of the illustrated blocks or diamonds may be optional, or certain of the illustrated blocks or diamonds may not be employed.

In operation of this example embodiment, responsive to an occurrence of a designated triggering event, the EGM 100 initiates a start of a play of a secondary game, as indicated by block 510. The EGM 100 displays an indication to the player that explains that upon display of a prompt on the display device the player needs to make a sound as loud as possible into the microphone 120*a*, and that louder sounds will result in certain actions in the play of the game, as indicated by block 520. The EGM 100 displays the prompt on the display device, as indicated by block 530. The EGM 100 receives the sound by the player using the microphone 120*a*, as indicated by block 540. The EGM 100 determines a decibel level of the sound made by the player in the interior area 304 of the enclosure 300, as indicated by block 550. Responsive to the decibel level being above a first decibel level threshold, the EGM 100 causes the display device 110 of the EGM 100 to display a first action in a play of the game, as indicated by block 560. Responsive to the decibel level being below the first decibel level threshold, the EGM 100 causes the display device 110 of the EGM 100 to display a second different action in a play of the game, as indicated by block 570. The EGM 100 determines an award based on the play of the game (which may in part includes one or more of the actions that occurs during the play of the game), as indicated by block 580. The EGM 100 can provide that determined award to the player.

It should be appreciated that employing such player sound inputs for a game or otherwise in a casino environment (without the enclosure of the present disclosure) can be technically difficult due to all of the numerous sounds in a casino (such as but not limited to sounds from other EGMs, sounds from other people (such as other players or casino personal), sounds from music provided by the casino, and/or sounds from casino announcements, etc). The gaming system of the present disclosure including an isolating enclosure such as the enclosure 300 of the present disclosure overcomes theses technical difficulties.

It should also be appreciated that while the illustrated example enclosure 300 include two handheld microphones 120*a* and 120*b* for two players at the EGM 100 in the enclosure 300, the present disclosure contemplates that microphones can be built into the EGM 100 rather than connected by electrical cords. This latter embodiment reduces the need for such handheld microphones, reduces the likelihood that a microphone will be broken, and reduce cleanliness related issues with the microphone.

It should also be appreciated that this illustrated example includes two handheld microphones 120*a* and 120*b* for two players at the EGM 100 in the enclosure 300, such that the two players can both make sound inputs into the respective microphones at the same time or at different times. In various example embodiments, the EGM 100 can be configured to enable the players to: (1) make competing sound inputs for a play of a game or otherwise; or (2) to work together to make cooperating sound inputs for a play of a game or otherwise.

In various example embodiments, the enclosure 300 also functions to provide a sub environment in the casino with cleaner or more filtered air for one or more people such as players in the enclosure 300. This enables players to be in an casino environment but subjected to substantially less smoke than can be present in certain casino environments where smoking is permitted. In various such embodiments, the enclosure 300 includes a suitable ventilation system (not shown) that provides filtered air to the interior area of the enclosure 300.

In various other embodiments, the enclosure 300 also functions to provide a sub environment in the casino with filtered air for one or more people such as players in the enclosure 300 who want to smoke. This enables players to be in an casino environment that does not allow smoking but will allow smoking inside of the enclosure 300 where the smoke or air can be filtered.

In various embodiments, the enclosure 300 functions to provide an interior area 304 in which the player can better hear the sounds made by the EGM 100 and thus have an enriched gaming experience.

In various embodiments, the enclosure 300 functions to provide an interior area 304 in which the player can concentrate on game play without various distractions such as noise distractions.

In various embodiments, the enclosure 300 functions to provide an interior area 304 in which the EGM 100 can provide an enhance augmented reality, 3D, or 4D gaming experience for the player in the enclosure 300. For example, in various embodiments, the gaming system of the present disclosure controls the air conditions in the enclosure 300 by providing air with designated smell(s) in the enclosure 300, by providing air at designated speeds (such as different winds) in the enclosure 300, by providing air with designated densities, humidity (such as vapors, smoke, etc) in the enclosure 300. In other examples, in various embodiments, the gaming system of the present disclosure controls player feedback in the enclosure 300 by providing haptic feedback such as player chair vibration in the enclosure 300 at designated times.

In various embodiments, the enclosure 300 functions to provide a bonus display device such as an additional bonus display device (not shown) in the enclosure 300. In various such embodiments, the bonus display device is attached to one of the side wall or the roof of the enclosure 300. In certain such embodiments, the bonus display device can be configured to release one or more awards for the player in the enclosure 300 such as one or more award gift cards.

In various embodiments, the enclosure 300 functions to provide additional sounds in the enclosure 300. In various such embodiments, the sounds are produced by an additional sound system (not shown) in or connected to the enclosure. In various such embodiments, the sound system produces music or produces other sounds to enhance a player experience such as a player celebration experience when a large award is won by the player in the enclosure 300.

In various embodiments, the enclosure 300 also functions to provide a more private and secure interior area 304 for players. For example, players in the enclosure 300 do not need to worry about other people bumping into them and potentially stealing any of the player's possessions.

In various embodiments, the enclosure 300 also functions to provide a separate interior area 304 for designated players. For example, only players having a certain player status (such as via a player tracking system) are permitted by the casino to use the enclosure 300. This provides these players with a certain VIP status in the casino environment.

In various embodiments, the casino or the gaming system can enable the player to purchase time in the enclosure 300. For example, the gaming system can enable players to purchase time in the enclosure 300 via credits from EGM 100, player tracking points, (such as via a VIP/member player tracking card, or via currency. In various embodiments, certain features or functions of the enclosure 300 are provided based on the purchase or amount of the purchase. For example, certain experiences such as 4D experiences are provided to the player based on the player purchase time. In various embodiments, the gaming system enables the player to enter the enclosure after the player after the player pays with credits/tokens/vouchers.

In various embodiments, the casino can enable the player to win time in the enclosure 300. In various such embodiments, the greater the wager by the player, the greater the time in the enclosure 300 that can be won. In various embodiments, this is on a single wager or a plurality of wagers over a designated period of time.

In various embodiments, the enclosure 300 functions to provide an interior area 304 in which the player can order food, beverages, and/or other items using a communication system (not shown) of the enclosure 300. In various such embodiments, the EGM 100 enables the player to make such orders. In other embodiments, the enclosure 300 additionally includes a communication system (not shown) that includes one or more devices such as one or more display/input devices that enables the player to make such orders. In certain such embodiments, the communication system is configured to operate with a player tracking system to facilitate such functionality for the player. In certain such embodiments, the enclosure 300 can include one or more openable windows (not shown) that facilitate the delivery of the food or beverage to the player without requiring the access door 380 to be opened. In various embodiments, the enclosure 300 includes a suitable vending machine or station that enables the player to purchase or otherwise obtain items such as food and/or beverage. In various such embodiments, these items are delivered to the player in the enclosure via one or more item communication devices such as automatically (dropped into drop box or via pipe that is connected to enclosure 300). In other embodiments, the vending machine is integrated into the EGM or enclosure 300.

In various embodiments, the enclosure 300 includes one or more gaming machine type candles that can function in a similar manner to a candle of a gaming machine. The enclosure candle can be attached to any one of the structures of the enclosure 300 such as attached to the top or one of the side walls of the enclosure 300. In certain embodiments, the enclosure candle is connected to the EGM 100 and provides any needed notifications for the EGM 100 (because the candle of the EGM 100 may not be fully visible since the EGM 100 is in the enclosure 300). In other embodiments, the enclosure candle is controlled separately from the candle of the EGM and provides additional functionality for the enclosure 300—such as for enabling the player to request service of the EGM 100 or for other purposes (such as for ordering drinks).

In various embodiments, the enclosure 300 includes a lighting system (not shown) that includes one or more lights (not shown) configured to illuminate the interior area 304 of the enclosure 300. The light(s) can be attached to any one of the structures of the enclosure 300 such as attached to the top or one of the side walls of the enclosure 300. In certain embodiments, the lighting system is connected to the EGM 100 and is configured to provide different illumination inside of the enclosure 300 based on one or more states of the EGM 100. For example, the lighting system of the enclosure 300 and the EGM 100 may be configured to provide: (1) a first type of illumination in the enclosure 300 when the EGM 100 is not be played and no player is in the enclosure 300; (2) a second different type of illumination when a player is in the enclosure 300; (3) a third different type of illumination when a player is in the enclosure 300 and is playing a primary game of the EGM 100; (4) a fourth different type of illumination when a player is in the enclosure 300 and playing a primary game of the EGM 100 at a maximum wager level; (5) a fifth different type of illumination when a player is in the enclosure 300 about to play a triggered secondary or bonus game of the EGM 100; (6) a sixth different type of illumination when a player is in the enclosure 300 and is playing a secondary game of the EGM 100; (7) a seventh different type of illumination when a player is in the enclosure 300 and is playing primary or secondary game that requires the player to a make sounds (such as described above); (8) an eighth different type of illumination based on different decibel levels of the sounds made by the player in the enclosure 300; and/or (9) a night different type of illumination when player has been staying or playing the EGM 100 for a designated period of time (such as an hours) which can be used for suitable responsible gaming tracking purposes. Thus, in various embodiments of the present disclosure, the enclosure 300 functions to provide illumination that is coordinated with the operation of the EGM 100 or otherwise.

In various embodiments of the present disclosure, multiple gaming systems 50 may be adjacently employed such that multiple enclosures 300 of such gaming system 50 are adjacently arranged.

In various embodiments, the enclosure 300 includes an advertising system. In various such embodiments, this advertising system can be configured to display advertisements such as movie previews (with/without an attractive sound) outside or inside the enclosure 300.

Gaming Systems

The above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. A "gaming system" as used herein refers to various configurations of: (a) one or more central servers, central controllers, or remote hosts configured to operate with one or more EGMs; and/or (b) one or more stand-alone EGMs. In other words, in various embodiments, the gaming system of the present disclosure includes: (a) one or more electronic gaming machines in combination with one or more central servers, central controllers, or remote hosts; (a) a single electronic gaming machine; or (b) a plurality of electronic gaming machines in combination with one another.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system includes a plurality of EGMs that are each configured to communicate with a central server, central controller, or remote host through a data network.

In certain embodiments in which the gaming system includes an EGM in combination with a central server, central controller, or remote host, the central server, central controller, or remote host is any suitable computing device (such as a server) that includes at least one processor and at least one memory device or data storage device. As further described herein, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. One, more than one, or each of the functions of the central server, central controller, or remote host may be performed by the at least one processor of the EGM. Further, one, more than one, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM, are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client). In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. In certain embodiments in which the data network is a WAN, the gaming system includes a central server, central controller, or remote host and an EGM, each located in a different gaming establishment in a same geographic area, such as a same city or a same state. Gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet (such as the Internet) or an intranet. In certain such embodiments, an Internet browser of the EGM is usable to access an Internet game page from any location where an Internet connection is available. In one such embodiment, after the EGM accesses the Internet game page, the central server, central controller, or remote host identifies a player before enabling that player to place any wagers on any plays of any wagering games. In one example, the central server, central controller, or remote host identifies the player by requiring a player account of the player to be logged into via an input of a unique username and password combination assigned to the player. The central server, central controller, or remote host may, however, identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the Internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the Internet browser of the EGM. Examples of implementations of Internet-based gaming are further described in U.S. Pat. No. 8,764,566, entitled "Internet Remote Game Server," and U.S. Pat. No. 8,147,334, entitled "Universal Game Server."

The central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile Internet network), or any other suitable medium. The expansion in the quantity of computing devices and the quantity and speed of Internet connections in recent years increases opportunities for players to use a variety of EGMs to play games from an ever-increasing quantity of remote sites. Additionally, the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 7:
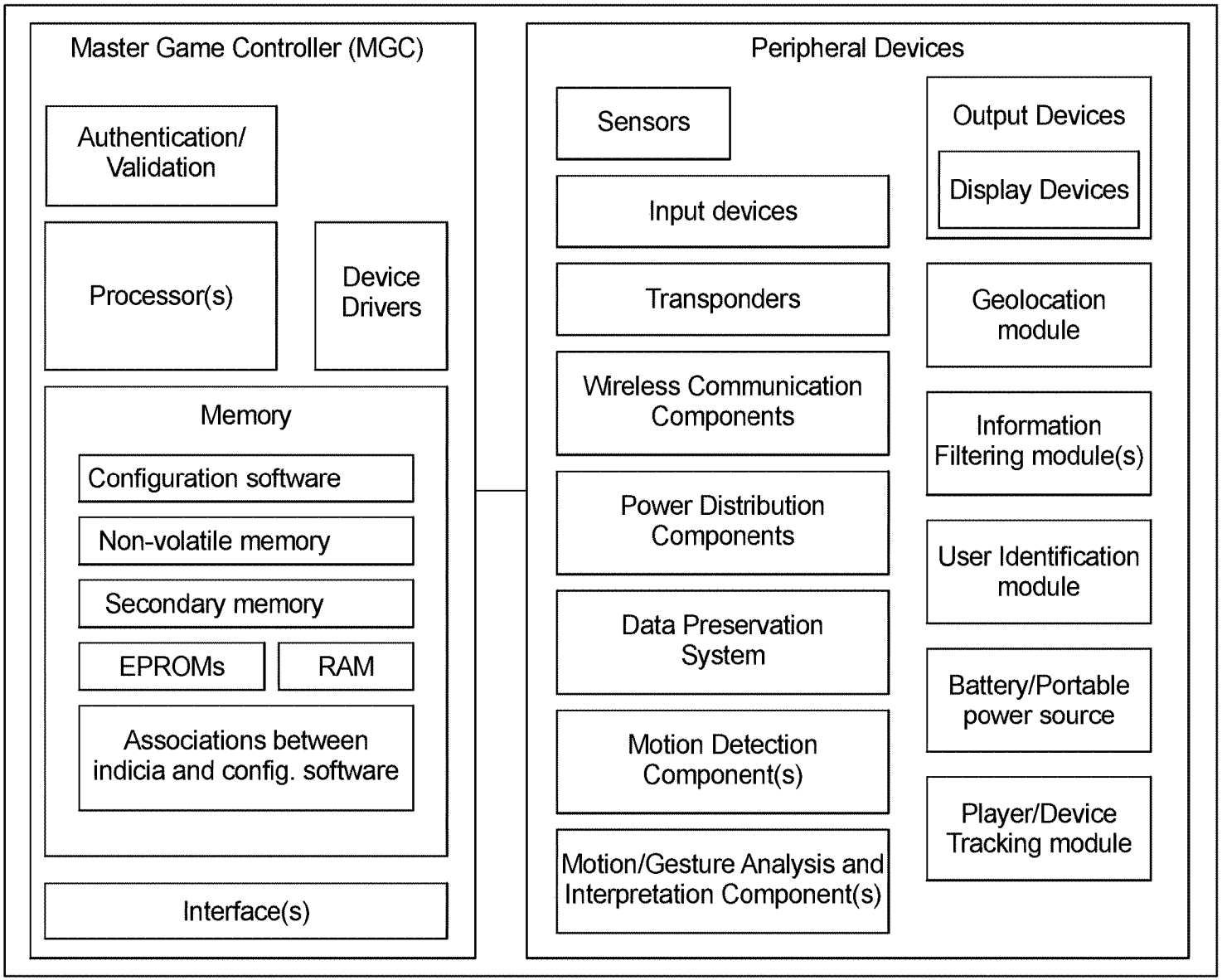
FIG. 7 is a schematic block diagram of one embodiment of an electronic configuration of an example gaming system disclosed herein.

It should be appreciated that FIGS. 1 and 7 include example EGMs 100 and 1000, and different EGMs may be implemented using different combinations of the components described below but not shown.

In these embodiments, the EGM includes a master gaming controller configured to communicate with and to operate with a plurality of peripheral devices.

The master gaming controller includes at least one processor. The at least one processor is any suitable processing device or set of processing devices, such as a microprocessor, a microcontroller-based platform, a suitable integrated circuit, or one or more application-specific integrated circuits (ASICs), configured to execute software enabling various configuration and reconfiguration tasks, such as: (1) communicating with a remote source (such as a server that stores authentication information or game information) via a communication interface of the master gaming controller; (2) converting signals read by an interface to a format corresponding to that used by software or memory of the EGM; (3) accessing memory to configure or reconfigure game parameters in the memory according to indicia read from the EGM; (4) communicating with interfaces and the peripheral devices (such as input/output devices); and/or (5) controlling the peripheral devices. In certain embodiments, one or more components of the master gaming controller (such as the at least one processor) reside within a housing of the EGM (described below), while in other embodiments at least one component of the master gaming controller resides outside of the housing of the EGM.

The master gaming controller also includes at least one memory device, which includes: (1) volatile memory (e.g., RAM, which can include non-volatile RAM, magnetic RAM, ferroelectric RAM, and any other suitable forms); (2) non-volatile memory (e.g., disk memory, FLASH memory, EPROMs, EEPROMs, memristor-based non-volatile solid-state memory, etc.); (3) unalterable memory (e.g., EPROMs); (4) read-only memory; and/or (5) a secondary memory storage device, such as a non-volatile memory device, configured to store gaming software related information (the gaming software related information and the memory may be used to store various audio files and games not currently being used and invoked in a configuration or reconfiguration). Any other suitable magnetic, optical, and/or semiconductor memory may operate in conjunction with the EGM disclosed herein. In certain embodiments, the at least one memory device resides within the housing of the EGM (described below), while in other embodiments at least one component of the at least one memory device resides outside of the housing of the EGM.

The at least one memory device is configured to store, for example: (1) configuration software, such as all the parameters and settings for a game playable on the EGM; (2) associations between configuration indicia read from an EGM with one or more parameters and settings; (3) communication protocols configured to enable the at least one processor to communicate with the peripheral devices; and/or (4) communication transport protocols (such as TCP/IP, USB, Firewire, IEEE1394, Bluetooth, IEEE 802.11x (IEEE 802.11 standards), hiperlan/2, HomeRF, etc.) configured to enable the EGM to communicate with local and non-local devices using such protocols. In one implementation, the master gaming controller communicates with other devices using a serial communication protocol. A few non-limiting examples of serial communication protocols that other devices, such as peripherals (e.g., a bill validator or a ticket printer), may use to communicate with the master game controller include USB, RS-232, and Netplex (a proprietary protocol developed by IGT).

In certain embodiments, the at least one memory device is configured to store program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM. In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an Internet or intranet).

As will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

The at least one memory device also stores a plurality of device drivers. Examples of different types of device drivers include device drivers for EGM components and device drivers for the peripheral components. Typically, the device drivers utilize various communication protocols that enable communication with a particular physical device. The device driver abstracts the hardware implementation of that device. For example, a device driver may be written for each type of card reader that could potentially be connected to the EGM. Non-limiting examples of communication protocols used to implement the device drivers include Netplex, USB, Serial, Ethernet 175, Firewire, I/O debouncer, direct memory map, serial, PCI, parallel, RF, Bluetooth™' near-field communications (e.g., using near-field magnetics), 802.11 (WiFi), etc. In one embodiment, when one type of a particular device is exchanged for another type of the particular device, the at least one processor of the EGM loads the new device driver from the at least one memory device to enable communication with the new device. For instance, one type of card reader in the EGM can be replaced with a second different type of card reader when device drivers for both card readers are stored in the at least one memory device.

In certain embodiments, the software units stored in the at least one memory device can be upgraded as needed. For instance, when the at least one memory device is a hard drive, new games, new game options, new parameters, new settings for existing parameters, new settings for new parameters, new device drivers, and new communication protocols can be uploaded to the at least one memory device from the master game controller or from some other external device. As another example, when the at least one memory device includes a CD/DVD drive including a CD/DVD configured to store game options, parameters, and settings, the software stored in the at least one memory device can be upgraded by replacing a first CD/DVD with a second CD/DVD. In yet another example, when the at least one memory device uses flash memory or EPROM units configured to store games, game options, parameters, and settings, the software stored in the flash and/or EPROM memory units can be upgraded by replacing one or more memory units with new memory units that include the upgraded software. In another embodiment, one or more of the memory devices, such as the hard drive, may be employed in a game software download process from a remote software server.

In some embodiments, the at least one memory device also stores authentication and/or validation components configured to authenticate/validate specified EGM components and/or information, such as hardware components, software components, firmware components, peripheral device components, user input device components, information received from one or more user input devices, information stored in the at least one memory device, etc. Examples of various authentication and/or validation components are described in U.S. Pat. No. 6,620,047, entitled "Electronic Gaming Apparatus Having Authentication Data Sets."

In certain embodiments, the peripheral devices include several device interfaces, such as: (1) at least one output device including at least one display device; (2) at least one input device (which may include contact and/or non-contact interfaces); (3) at least one transponder; (4) at least one wireless communication component; (5) at least one wired/wireless power distribution component; (6) at least one sensor; (7) at least one data preservation component; (8) at least one motion/gesture analysis and interpretation component; (9) at least one motion detection component; (10) at least one portable power source; (11) at least one geolocation module; (12) at least one user identification module; (13) at least one player/device tracking module; and (14) at least one information filtering module.

The at least one output device includes at least one display device configured to display any game(s) displayed by the EGM and any suitable information associated with such game(s). In certain embodiments, the display devices are connected to or mounted on a housing of the EGM (described below). In various embodiments, the display devices serve as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM 100 illustrated in FIG. 1 includes a central display device, a player tracking display, a credit display, and a bet display.

In various embodiments, one or more of the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. The display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more keno grids, one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, the at least one output device includes a payout device. In these embodiments, after the EGM receives an actuation of a cashout device (described below), the EGM causes the payout device to provide a payment to the player. In one embodiment, the payout device is one or more of: (a) a ticket printer and dispenser configured to print and dispense a ticket or credit slip associated with a monetary value, wherein the ticket or credit slip may be redeemed for its monetary value via a cashier, a kiosk, or other suitable redemption system; (b) a bill dispenser configured to dispense paper currency; (c) a coin dispenser configured to dispense coins or tokens (such as into a coin payout tray); and (d) any suitable combination thereof. The example EGM 100 illustrated in FIG. 1 includes a ticket printer and dispenser 2136. Examples of ticket-in ticket-out (TITO) technology are described in U.S. Pat. No. 5,429,361, entitled "Gaming Machine Information, Communication and Display System"; U.S. Pat. No. 5,470,079, entitled "Gaming Machine Accounting and Monitoring System"; U.S. Pat. No. 5,265,874, entitled "Cashless Gaming Apparatus and Method"; U.S. Pat. No. 6,729,957, entitled "Gaming Method and Host Computer with Ticket-In/Ticket-Out Capability"; U.S. Pat. No. 6,729,958, entitled "Gaming System with Ticket-In/Ticket-Out Capability"; U.S. Pat. No. 6,736,725, entitled "Gaming Method and Host Computer with Ticket-In/Ticket-Out Capability"; U.S. Pat. No. 7,275,991, entitled "Slot Machine with Ticket-In/Ticket-Out Capability"; and U.S. Pat. No. 6,048,269, entitled "Coinless Slot Machine System and Method".

In certain embodiments, rather than dispensing bills, coins, or a physical ticket having a monetary value to the player following receipt of an actuation of the cashout device, the payout device is configured to cause a payment to be provided to the player in the form of an electronic funds transfer, such as via a direct deposit into a bank account, a casino account, or a prepaid account of the player; via a transfer of funds onto an electronically recordable identification card or smart card of the player; or via sending a virtual ticket having a monetary value to an electronic device of the player. Examples of providing payment using virtual tickets are described in U.S. Pat. No. 8,613,659, entitled "Virtual Ticket-In and Ticket-Out on a Gaming Machine."

While any credit balances, any wagers, any values, and any awards are described herein as amounts of monetary credits or currency, one or more of such credit balances, such wagers, such values, and such awards may be for non-monetary credits, promotional credits, of player tracking points or credits.

In certain embodiments, the at least one output device is a sound generating device controlled by one or more sound cards. In one such embodiment, the sound generating device includes one or more speakers or other sound generating hardware and/or software configured to generate sounds, such as by playing music for any games or by playing music for other modes of the EGM, such as an attract mode. The example EGM 100 illustrated in FIG. 1 includes a plurality of speakers. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

The at least one input device may include any suitable device that enables an input signal to be produced and received by the at least one processor of the EGM.

In one embodiment, the at least one input device includes a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. The example EGM 100 illustrated in FIG. 1 includes a combined bill and ticket acceptor and a coin slot.

In one embodiment, the at least one input device includes a payment device configured to enable the EGM to be funded via an electronic funds transfer, such as a transfer of funds from a bank account. In another embodiment, the EGM includes a payment device configured to communicate with a mobile device of a player, such as a mobile phone, a radio frequency identification tag, or any other suitable wired or wireless device, to retrieve relevant information associated with that player to fund the EGM. Examples of funding an EGM via communication between the EGM and a mobile device (such as a mobile phone) of a player are described in U.S. Patent Application Publication No. 2013/0344942, entitled "Avatar as Security Measure for Mobile Device Use with Electronic Gaming Machine." When the EGM is funded, the at least one processor determines the amount of funds entered and displays the corresponding amount on a credit display or any other suitable display as described below.

In certain embodiments, the at least one input device includes at least one wagering or betting device. In various embodiments, the one or more wagering or betting devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). One such wagering or betting device is as a maximum wager or bet device that, when actuated, causes the EGM to place a maximum wager on a play of a game. Another such wagering or betting device is a repeat bet device that, when actuated, causes the EGM to place a wager that is equal to the previously-placed wager on a play of a game. A further such wagering or betting device is a bet one device that, when actuated, causes the EGM to increase the wager by one credit. Generally, upon actuation of one of the wagering or betting devices, the quantity of credits displayed in a credit meter (described below) decreases by the amount of credits wagered, while the quantity of credits displayed in a bet display (described below) increases by the amount of credits wagered.

In various embodiments, the at least one input device includes at least one game play activation device. In various embodiments, the one or more game play initiation devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). After a player appropriately funds the EGM and places a wager, the EGM activates the game play activation device to enable the player to actuate the game play activation device to initiate a play of a game on the EGM (or another suitable sequence of events associated with the EGM). After the EGM receives an actuation of the game play activation device, the EGM initiates the play of the game. The example EGM 100 illustrated in FIG. 1 includes a game play activation device in the form of a game play initiation button. In other embodiments, the EGM begins game play automatically upon appropriate funding rather than upon utilization of the game play activation device.

In other embodiments, the at least one input device includes a cashout device. In various embodiments, the cashout device is: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). When the EGM receives an actuation of the cashout device from a player and the player has a positive (i.e., greater-than-zero) credit balance, the EGM initiates a payout associated with the player's credit balance. The example EGM 100 illustrated in FIG. 1 includes a cashout device in the form of a cashout button.

In various embodiments, the at least one input device includes a plurality of buttons that are programmable by the EGM operator to, when actuated, cause the EGM to perform particular functions. For instance, such buttons may be hard keys, programmable soft keys, or icons icon displayed on a display device of the EGM (described below) that are actuatable via a touch screen of the EGM (described below) or via use of a suitable input device of the EGM (such as a mouse or a joystick). The example EGM 100 illustrated in FIG. 1 includes a plurality of such buttons.

In certain embodiments, the at least one input device includes a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In embodiments including a player tracking system, as further described below, the at least one input device includes a card reader in communication with the at least one processor of the EGM. The example EGM 100 illustrated in FIG. 1 includes a card reader. The card reader is configured to read a player identification card inserted into the card reader.

The at least one wireless communication component includes one or more communication interfaces having different architectures and utilizing a variety of protocols, such as (but not limited to) 802.11 (WiFi); 802.15 (including Bluetooth™); 802.16 (WiMax); 802.22; cellular standards such as CDMA, CDMA2000, and WCDMA; Radio Frequency (e.g., RFID); infrared; and Near Field Magnetic communication protocols. The at least one wireless communication component 1056 transmits electrical, electromagnetic, or optical signals that carry digital data streams or analog signals representing various types of information.

The at least one wired/wireless power distribution component includes components or devices that are configured to provide power to other devices. For example, in one embodiment, the at least one power distribution component includes a magnetic induction system that is configured to provide wireless power to one or more user input devices near the EGM. In one embodiment, a user input device docking region is provided, and includes a power distribution component that is configured to recharge a user input device without requiring metal-to-metal contact. In one embodiment, the at least one power distribution component is configured to distribute power to one or more internal components of the EGM, such as one or more rechargeable power sources (e.g., rechargeable batteries) located at the EGM.

In certain embodiments, the at least one sensor includes at least one of: optical sensors, pressure sensors, RF sensors, infrared sensors, image sensors, thermal sensors, and biometric sensors. The at least one sensor may be used for a variety of functions, such as: detecting movements and/or gestures of various objects within a predetermined proximity to the EGM; detecting the presence and/or identity of various persons (e.g., players, casino employees, etc.), devices (e.g., user input devices), and/or systems within a predetermined proximity to the EGM.

The at least one data preservation component is configured to detect or sense one or more events and/or conditions that, for example, may result in damage to the EGM and/or that may result in loss of information associated with the EGM. Additionally, the data preservation system may be operable to initiate one or more appropriate action(s) in response to the detection of such events/conditions.

The at least one motion/gesture analysis and interpretation component is configured to analyze and/or interpret information relating to detected player movements and/or gestures to determine appropriate player input information relating to the detected player movements and/or gestures. For example, in one embodiment, the at least one motion/gesture analysis and interpretation component is configured to perform one or more of the following functions: analyze the detected gross motion or gestures of a player; interpret the player's motion or gestures (e.g., in the context of a casino game being played) to identify instructions or input from the player; utilize the interpreted instructions/input to advance the game state; etc. In other embodiments, at least a portion of these additional functions may be implemented at a remote system or device.

The at least one portable power source enables the EGM to operate in a mobile environment. For example, in one embodiment, the EGM includes one or more rechargeable batteries.

The at least one geolocation module is configured to acquire geolocation information from one or more remote sources and use the acquired geolocation information to determine information relating to a relative and/or absolute position of the EGM. For example, in one implementation, the at least one geolocation module is configured to receive GPS signal information for use in determining the position or location of the EGM. In another implementation, the at least one geolocation module is configured to receive multiple wireless signals from multiple remote devices (e.g., EGMs, servers, wireless access points, etc.) and use the signal information to compute position/location information relating to the position or location of the EGM.

The at least one user identification module is configured to determine the identity of the current user or current owner of the EGM. For example, in one embodiment, the current user is required to perform a login process at the EGM in order to access one or more features. Alternatively, the EGM is configured to automatically determine the identity of the current user based on one or more external signals, such as an RFID tag or badge worn by the current user and that provides a wireless signal to the EGM that is used to determine the identity of the current user. In at least one embodiment, various security features are incorporated into the EGM to prevent unauthorized users from accessing confidential or sensitive information.

The at least one information filtering module is configured to perform filtering (e.g., based on specified criteria) of selected information to be displayed at one or more displays of the EGM.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. U.S. Pat. No. 7,290,072 describes a variety of EGMs including one or more communication ports that enable the EGMs to communicate and operate with one or more external peripherals.

As generally described above, in certain embodiments, such as the example EGM 100 illustrated in FIG. 1, the EGM has a support structure, housing, or cabinet that provides support for a plurality of the input devices and the output devices of the EGM. Further, the EGM is configured such that a player may operate it while standing or sitting.

In various embodiments, the EGM is positioned on a base or stand, or is configured as a pub-style tabletop game (not shown) that a player may operate typically while sitting. Different example EGMs may have varying housing and display configurations.

In certain embodiments, the EGM is a device that has obtained approval from a regulatory gaming commission, and in other embodiments, the EGM is a device that has not obtained approval from a regulatory gaming commission.

The EGMs described above are merely three examples of different types of EGMs. Certain of these example EGMs may include one or more elements that may not be included in all gaming systems, and these example EGMs may not include one or more elements that are included in other gaming systems. For example, certain EGMs include a coin acceptor while others do not.

Operation of Primary or Base Games and/or Secondary or Bonus Games

In various embodiments, an EGM may be implemented in one of a variety of different configurations. In various embodiments, the EGM may be implemented as one of: (a) a dedicated EGM in which computerized game programs executable by the EGM for controlling any primary or base games (referred to herein as "primary games") and/or any secondary or bonus games or other functions (referred to herein as "secondary games") displayed by the EGM are provided with the EGM before delivery to a gaming establishment or before being provided to a player; and (b) a changeable EGM in which computerized game programs executable by the EGM for controlling any primary games and/or secondary games displayed by the EGM are downloadable or otherwise transferred to the EGM through a data network or remote communication link; from a USB drive, flash memory card, or other suitable memory device; or in any other suitable manner after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. Examples of this type of award evaluation are described in U.S. Pat. No. 7,470,183, entitled "Finite Pool Gaming Method and Apparatus"; U.S. Pat. No. 7,563,163, entitled "Gaming Device Including Outcome Pools for Providing Game Outcomes"; U.S. Pat. No. 7,833,092, entitled "Method and System for Compensating for Player Choice in a Game of Chance"; U.S. Pat. No. 8,070,579, entitled "Bingo System with Downloadable Common Patterns"; and U.S. Pat. No. 8,398,472, entitled "Central Determination Poker Game."

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. Examples of this type of award determination are described in U.S. Pat. No. 7,753,774, entitled "Using Multiple Bingo Cards to Represent Multiple Slot Paylines and Other Class III Game Options"; U.S. Pat. No. 7,731,581, entitled "Multi-Player Bingo Game with Multiple Alternative Outcome Displays"; U.S. Pat. No. 7,955,170, entitled "Providing Non-Bingo Outcomes for a Bingo Game"; U.S. Pat. No. 8,070,579, entitled "Bingo System with Downloadable Common Patterns"; and U.S. Pat. No. 8,500,538, entitled "Bingo Gaming System and Method for Providing Multiple Outcomes from Single Bingo Pattern."

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database configured to store player profiles, (b) a player tracking module configured to track players (as described below), and (c) a credit system configured to provide automated transactions. Examples of such accounting systems are described in U.S. Pat. No. 6,913,534, entitled "Gaming Machine Having a Lottery Game and Capability for Integration with Gaming Device Accounting System and Player Tracking System," and U.S. Pat. No. 8,597,116, entitled "Virtual Player Tracking and Related Services."

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a keno-type game, the gaming system includes one or more keno boards in either an electromechanical form or in a video form. Each keno board displays a plurality of indicia or symbols, such as numbers, letters, or other images that typically correspond to a theme associated with the gaming system.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. Examples of ways to win award determinations are described in U.S. Pat. No. 8,012,011, entitled "Gaming Device and Method Having Independent Reels and Multiple Ways of Winning"; U.S. Pat. No. 8,241,104, entitled "Gaming Device and Method Having Designated Rules for Determining Ways To Win"; and U.S. Pat. No. 8,430,739, entitled "Gaming System and Method Having Wager Dependent Different Symbol Evaluations."

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. Examples of progressive gaming systems are described in U.S. Pat. No. 7,585,223, entitled "Server Based Gaming System Having Multiple Progressive Awards"; U.S. Pat. No. 7,651,392, entitled "Gaming Device System Having Partial Progressive Payout"; U.S. Pat. No. 7,666,093, entitled "Gaming Method and Device Involving Progressive Wagers"; U.S. Pat. No. 7,780,523, entitled "Server Based Gaming System Having Multiple Progressive Awards"; and U.S. Pat. No. 8,337,298, entitled "Gaming Device Having Multiple Different Types of Progressive Awards."

As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). The secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. Any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for providing the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. Examples of group gaming systems are described in U.S. Pat. No. 8,070,583, entitled "Server Based Gaming System and Method for Selectively Providing One or More Different Tournaments"; U.S. Pat. No. 8,500,548, entitled "Gaming System and Method for Providing Team Progressive Awards"; and U.S. Pat. No. 8,562,423, entitled "Method and Apparatus for Rewarding Multiple Game Players for a Single Win."

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a mobile phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. Examples of player tracking systems are described in U.S. Pat. No. 6,722,985, entitled "Universal Player Tracking System"; U.S. Pat. No. 6,908,387, entitled "Player Tracking Communication Mechanisms in a Gaming Machine"; U.S. Pat. No. 7,311,605, entitled "Player Tracking Assembly for Complete Patron Tracking for Both Gaming and Non-Gaming Casino Activity"; U.S. Pat. No. 7,611,411, entitled "Player Tracking Instruments Having Multiple Communication Modes"; U.S. Pat. No. 7,617,151, entitled "Alternative Player Tracking Techniques"; and U.S. Pat. No. 8,057,298, entitled "Virtual Player Tracking and Related Services."

Web-Based Gaming

In various embodiments, the gaming system includes one or more servers configured to communicate with a personal gaming device—such as a smartphone, a tablet computer, a desktop computer, or a laptop computer—to enable web-based game play using the personal gaming device. In various embodiments, the player must first access a gaming website via an Internet browser of the personal gaming device or execute an application (commonly called an "app") installed on the personal gaming device before the player can use the personal gaming device to participate in web-based game play. In certain embodiments, the one or more servers and the personal gaming device operate in a thin-client environment. In these embodiments, the personal gaming device receives inputs via one or more input devices (such as a touch screen and/or physical buttons), the personal gaming device sends the received inputs to the one or more servers, the one or more servers make various determinations based on the inputs and determine content to be displayed (such as a randomly determined game outcome and corresponding award), the one or more servers send the content to the personal gaming device, and the personal gaming device displays the content.

In certain such embodiments, the one or more servers must identify the player before enabling game play on the personal gaming device (or, in some embodiments, before enabling monetary wager-based game play on the personal gaming device). In these embodiments, the player must identify herself to the one or more servers, such as by inputting the player's unique username and password combination, providing an input to a biometric sensor (e.g., a fingerprint sensor, a retinal sensor, a voice sensor, or a facial-recognition sensor), or providing any other suitable information.

Once identified, the one or more servers enable the player to establish an account balance from which the player can draw credits usable to wager on plays of a game. In certain embodiments, the one or more servers enable the player to initiate an electronic funds transfer to transfer funds from a bank account to the player's account balance. In other embodiments, the one or more servers enable the player to make a payment using the player's credit card, debit card, or other suitable device to add money to the player's account balance. In other embodiments, the one or more servers enable the player to add money to the player's account balance via a peer-to-peer type application, such as PayPal or Venmo. The one or more servers also enable the player to cash out the player's account balance (or part of it) in any suitable manner, such as via an electronic funds transfer, by initiating creation of a paper check that is mailed to the player, or by initiating printing of a voucher at a kiosk in a gaming establishment.

In certain embodiments, the one or more servers include a payment server that handles establishing and cashing out players' account balances and a separate game server configured to determine the outcome and any associated award for a play of a game. In these embodiments, the game server is configured to communicate with the personal gaming device and the payment device, and the personal gaming device and the payment device are not configured to directly communicate with one another. In these embodiments, when the game server receives data representing a request to start a play of a game at a desired wager, the game server sends data representing the desired wager to the payment server. The payment server determines whether the player's account balance can cover the desired wager (i.e., includes a monetary balance at least equal to the desired wager).

If the payment server determines that the player's account balance cannot cover the desired wager, the payment server notifies the game server, which then instructs the personal gaming device to display a suitable notification to the player that the player's account balance is too low to place the desired wager. If the payment server determines that the player's account balance can cover the desired wager, the payment server deducts the desired wager from the account balance and notifies the game server. The game server then determines an outcome and any associated award for the play of the game. The game server notifies the payment server of any nonzero award, and the payment server increases the player's account balance by the nonzero award. The game server sends data representing the outcome and any award to the personal gaming device, which displays the outcome and any award.

In certain embodiments, the one or more servers enable web-based game play using a personal gaming device only if the personal gaming device satisfies one or more jurisdictional requirements. In one embodiment, the one or more servers enable web-based game play using the personal gaming device only if the personal gaming device is located within a designated geographic area (such as within certain state or county lines or within the boundaries of a gaming establishment). In this embodiment, the geolocation module of the personal gaming device determines the location of the personal gaming device and sends the location to the one or more servers, which determine whether the personal gaming device is located within the designated geographic area. In various embodiments, the one or more servers enable non-monetary wager-based game play if the personal gaming device is located outside of the designated geographic area.

In various embodiments, the gaming system includes an EGM configured to communicate with a personal gaming device—such as a smartphone, a tablet computer, a desktop computer, or a laptop computer—to enable tethered mobile game play using the personal gaming device. Generally, in these embodiments, the EGM establishes communication with the personal gaming device and enables the player to play games on the EGM remotely via the personal gaming device. In certain embodiments, the gaming system includes a geo-fence system that enables tethered game play within a particular geographic area but not outside of that geographic area. Examples of tethering an EGM to a personal gaming device and geo-fencing are described in U.S. Patent Appl. Pub. No. 2013/0267324, entitled "Remote Gaming Method Allowing Temporary Inactivation Without Terminating Playing Session Due to Game Inactivity."

Social Network Integration

In certain embodiments, the gaming system is configured to communicate with a social network server that hosts or partially hosts a social networking website via a data network (such as the Internet) to integrate a player's gaming experience with the player's social networking account. This enables the gaming system to send certain information to the social network server that the social network server can use to create content (such as text, an image, and/or a video) and post it to the player's wall, newsfeed, or similar area of the social networking website accessible by the player's connections (and in certain cases the public) such that the player's connections can view that information. This also enables the gaming system to receive certain information from the social network server, such as the player's likes or dislikes or the player's list of connections. In certain embodiments, the gaming system enables the player to link the player's player account to the player's social networking account(s). This enables the gaming system to, once it identifies the player and initiates a gaming session (such as via the player logging in to a website (or an application) on the player's personal gaming device or via the player inserting the player's player tracking card into an EGM), link that gaming session to the player's social networking account(s). In other embodiments, the gaming system enables the player to link the player's social networking account(s) to individual gaming sessions when desired by providing the required login information.

For instance, in one embodiment, if a player wins a particular award (e.g., a progressive award or a jackpot award) or an award that exceeds a certain threshold (e.g., an award exceeding $1,000), the gaming system sends information about the award to the social network server to enable the server to create associated content (such as a screenshot of the outcome and associated award) and to post that content to the player's wall (or other suitable area) of the social networking website for the player's connections to see (and to entice them to play). In another embodiment, if a player joins a multiplayer game and there is another seat available, the gaming system sends that information to the social network sever to enable the server to create associated content (such as text indicating a vacancy for that particular game) and to post that content to the player's wall (or other suitable area) of the social networking website for the player's connections to see (and to entice them to fill the vacancy). In another embodiment, if the player consents, the gaming system sends advertisement information or offer information to the social network server to enable the social network server to create associated content (such as text or an image reflecting an advertisement and/or an offer) and to post that content to the player's wall (or other suitable area) of the social networking website for the player's connections to see. In another embodiment, the gaming system enables the player to recommend a game to the player's connections by posting a recommendation to the player's wall (or other suitable area) of the social networking website.

Differentiating Certain Gaming Systems from General Purpose Computing Devices

Certain of the gaming systems described herein, such as EGMs located in a casino or another gaming establishment, include certain components and/or are configured to operate in certain manners that differentiate these systems from general purpose computing devices, i.e., certain personal gaming devices such as desktop computers and laptop computers.

For instance, EGMs are highly regulated to ensure fairness and, in many cases, EGMs are configured to award monetary awards up to multiple millions of dollars. To satisfy security and regulatory requirements in a gaming environment, hardware and/or software architectures are implemented in EGMs that differ significantly from those of general purpose computing devices. For purposes of illustration, a description of EGMs relative to general purpose computing devices and some examples of these additional (or different) hardware and/or software architectures found in EGMs are described below.

At first glance, one might think that adapting general purpose computing device technologies to the gaming industry and EGMs would be a simple proposition because both general purpose computing devices and EGMs employ processors that control a variety of devices. However, due to at least: (1) the regulatory requirements placed on EGMs, (2) the harsh environment in which EGMs operate, (3) security requirements, and (4) fault tolerance requirements, adapting general purpose computing device technologies to EGMs can be quite difficult. Further, techniques and methods for solving a problem in the general purpose computing device industry, such as device compatibility and connectivity issues, might not be adequate in the gaming industry. For instance, a fault or a weakness tolerated in a general purpose computing device, such as security holes in software or frequent crashes, is not tolerated in an EGM because in an EGM these faults can lead to a direct loss of funds from the EGM, such as stolen cash or loss of revenue when the EGM is not operating properly or when the random outcome determination is manipulated.

Certain differences between general purpose computing devices and EGMs are described below. A first difference between EGMs and general purpose computing devices is that EGMs are state-based systems. A state-based system stores and maintains its current state in a non-volatile memory such that, in the event of a power failure or other malfunction, the state-based system can return to that state when the power is restored or the malfunction is remedied. For instance, for a state-based EGM, if the EGM displays an award for a game of chance but the power to the EGM fails before the EGM provides the award to the player, the EGM stores the pre-power failure state in a non-volatile memory, returns to that state upon restoration of power, and provides the award to the player. This requirement affects the software and hardware design on EGMs. General purpose computing devices are not state-based machines, and a majority of data is usually lost when a malfunction occurs on a general purpose computing device.

A second difference between EGMs and general purpose computing devices is that, for regulatory purposes, the software on the EGM utilized to operate the EGM has been designed to be static and monolithic to prevent cheating by the operator of the EGM. For instance, one solution that has been employed in the gaming industry to prevent cheating and to satisfy regulatory requirements has been to manufacture an EGM that can use a proprietary processor running instructions to provide the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used to operate a device during generation of the game of chance, can require burning a new EPROM approved by the gaming jurisdiction and reinstalling the new EPROM on the EGM in the presence of a gaming regulator. Regardless of whether the EPROM solution is used, to gain approval in most gaming jurisdictions, an EGM must demonstrate sufficient safeguards that prevent an operator or a player of an EGM from manipulating the EGM hardware and software in a manner that gives him an unfair, and in some cases illegal, advantage.

A third difference between EGMs and general purpose computing devices is authentication—EGMs storing code are configured to authenticate the code to determine if the code is unaltered before executing the code. If the code has been altered, the EGM prevents the code from being executed. The code authentication requirements in the gaming industry affect both hardware and software designs on EGMs. Certain EGMs use hash functions to authenticate code. For instance, one EGM stores game program code, a hash function, and an authentication hash (which may be encrypted). Before executing the game program code, the EGM hashes the game program code using the hash function to obtain a result hash and compares the result hash to the authentication hash. If the result hash matches the authentication hash, the EGM determines that the game program code is valid and executes the game program code. If the result hash does not match the authentication hash, the EGM determines that the game program code has been altered (i.e., may have been tampered with) and prevents execution of the game program code. Examples of EGM code authentication are described in U.S. Pat. No. 6,962,530, entitled "Authentication in a Secure Computerized Gaming System"; U.S. Pat. No. 7,043,641, entitled "Encryption in a Secure Computerized Gaming System"; U.S. Pat. No. 7,201,662, entitled "Method and Apparatus for Software Authentication"; and U.S. Pat. No. 8,627,097, entitled "System and Method Enabling Parallel Processing of Hash Functions Using Authentication Checkpoint Hashes."

A fourth difference between EGMs and general purpose computing devices is that EGMs have unique peripheral device requirements that differ from those of a general purpose computing device, such as peripheral device security requirements not usually addressed by general purpose computing devices. For instance, monetary devices, such as coin dispensers, bill validators, and ticket printers and computing devices that are used to govern the input and output of cash or other items having monetary value (such as tickets) to and from an EGM have security requirements that are not typically addressed in general purpose computing devices. Therefore, many general purpose computing device techniques and methods developed to facilitate device connectivity and device compatibility do not address the emphasis placed on security in the gaming industry.

To address some of the issues described above, a number of hardware/software components and architectures are utilized in EGMs that are not typically found in general purpose computing devices. These hardware/software components and architectures, as described below in more detail, include but are not limited to watchdog timers, voltage monitoring systems, state-based software architecture and supporting hardware, specialized communication interfaces, security monitoring, and trusted memory.

Certain EGMs use a watchdog timer to provide a software failure detection mechanism. In a normally-operating EGM, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits include a loadable timeout counter register to enable the operating software to set the timeout interval within a certain range of time. A differentiating feature of some circuits is that the operating software cannot completely disable the function of the watchdog timer. In other words, the watchdog timer always functions from the time power is applied to the board.

Certain EGMs use several power supply voltages to operate portions of the computer circuitry. These can be generated in a central power supply or locally on the computer board. If any of these voltages falls out of the tolerance limits of the circuitry they power, unpredictable operation of the EGM may result. Though most modern general purpose computing devices include voltage monitoring circuitry, these types of circuits only report voltage status to the operating software. Out of tolerance voltages can cause software malfunction, creating a potential uncontrolled condition in the general purpose computing device. Certain EGMs have power supplies with relatively tighter voltage margins than that required by the operating circuitry. In addition, the voltage monitoring circuitry implemented in certain EGMs typically has two thresholds of control. The first threshold generates a software event that can be detected by the operating software and an error condition then generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the EGM.

As described above, certain EGMs are state-based machines. Different functions of the game provided by the EGM (e.g., bet, play, result, points in the graphical presentation, etc.) may be defined as a state. When the EGM moves a game from one state to another, the EGM stores critical data regarding the game software in a custom non-volatile memory subsystem. This ensures that the player's wager and credits are preserved and to minimize potential disputes in the event of a malfunction on the EGM. In general, the EGM does not advance from a first state to a second state until critical information that enables the first state to be reconstructed has been stored. This feature enables the EGM to recover operation to the current state of play in the event of a malfunction, loss of power, etc. that occurred just before the malfunction. In at least one embodiment, the EGM is configured to store such critical information using atomic transactions.

Generally, an atomic operation in computer science refers to a set of operations that can be combined so that they appear to the rest of the system to be a single operation with only two possible outcomes: success or failure. As related to data storage, an atomic transaction may be characterized as series of database operations which either all occur, or all do not occur. A guarantee of atomicity prevents updates to the database occurring only partially, which can result in data corruption.

To ensure the success of atomic transactions relating to critical information to be stored in the EGM memory before a failure event (e.g., malfunction, loss of power, etc.), memory that includes one or more of the following criteria be used: direct memory access capability; data read/write capability which meets or exceeds minimum read/write access characteristics (such as at least 5.08 Mbytes/sec (Read) and/or at least 38.0 Mbytes/sec (Write)). Memory devices that meet or exceed the above criteria may be referred to as "fault-tolerant" memory devices.

Typically, battery-backed RAM devices may be configured to function as fault-tolerant devices according to the above criteria, whereas flash RAM and/or disk drive memory are typically not configurable to function as fault-tolerant devices according to the above criteria. Accordingly, battery-backed RAM devices are typically used to preserve EGM critical data, although other types of non-volatile memory devices may be employed. These memory devices are typically not used in typical general purpose computing devices.

Thus, in at least one embodiment, the EGM is configured to store critical information in fault-tolerant memory (e.g., battery-backed RAM devices) using atomic transactions. Further, in at least one embodiment, the fault-tolerant memory is able to successfully complete all desired atomic transactions (e.g., relating to the storage of EGM critical information) within a time period of 200 milliseconds or less. In at least one embodiment, the time period of 200 milliseconds represents a maximum amount of time for which sufficient power may be available to the various EGM components after a power outage event has occurred at the EGM.

As described previously, the EGM may not advance from a first state to a second state until critical information that enables the first state to be reconstructed has been atomically stored. After the state of the EGM is restored during the play of a game of chance, game play may resume and the game may be completed in a manner that is no different than if the malfunction had not occurred. Thus, for example, when a malfunction occurs during a game of chance, the EGM may be restored to a state in the game of chance just before when the malfunction occurred. The restored state may include metering information and graphical information that was displayed on the EGM in the state before the malfunction. For example, when the malfunction occurs during the play of a card game after the cards have been dealt, the EGM may be restored with the cards that were previously displayed as part of the card game. As another example, a bonus game may be triggered during the play of a game of chance in which a player is required to make a number of selections on a video display screen. When a malfunction has occurred after the player has made one or more selections, the EGM may be restored to a state that shows the graphical presentation just before the malfunction including an indication of selections that have already been made by the player. In general, the EGM may be restored to any state in a plurality of states that occur in the game of chance that occurs while the game of chance is played or to states that occur between the play of a game of chance.

Game history information regarding previous games played such as an amount wagered, the outcome of the game, and the like may also be stored in a non-volatile memory device. The information stored in the non-volatile memory may be detailed enough to reconstruct a portion of the graphical presentation that was previously presented on the EGM and the state of the EGM (e.g., credits) at the time the game of chance was played. The game history information may be utilized in the event of a dispute. For example, a player may decide that in a previous game of chance that they did not receive credit for an award that they believed they won. The game history information may be used to reconstruct the state of the EGM before, during, and/or after the disputed game to demonstrate whether the player was correct or not in the player's assertion. Examples of a state-based EGM, recovery from malfunctions, and game history are described in U.S. Pat. No. 6,804,763, entitled "High Performance Battery Backed RAM Interface"; U.S.

Pat. No. 6,863,608, entitled "Frame Capture of Actual Game Play"; U.S. Pat. No. 7,111,141, entitled "Dynamic NV-RAM"; and U.S. Pat. No. 7,384,339, entitled, "Frame Capture of Actual Game Play."

Another feature of EGMs is that they often include unique interfaces, including serial interfaces, to connect to specific subsystems internal and external to the EGM. The serial devices may have electrical interface requirements that differ from the "standard" EIA serial interfaces provided by general purpose computing devices. These interfaces may include, for example, Fiber Optic Serial, optically coupled serial interfaces, current loop style serial interfaces, etc. In addition, to conserve serial interfaces internally in the EGM, serial devices may be connected in a shared, daisy-chain fashion in which multiple peripheral devices are connected to a single serial channel.

The serial interfaces may be used to transmit information using communication protocols that are unique to the gaming industry. For example, IGT's Netplex is a proprietary communication protocol used for serial communication between EGMs. As another example, SAS is a communication protocol used to transmit information, such as metering information, from an EGM to a remote device. Often SAS is used in conjunction with a player tracking system.

Certain EGMs may alternatively be treated as peripheral devices to a casino communication controller and connected in a shared daisy chain fashion to a single serial interface. In both cases, the peripheral devices are assigned device addresses. If so, the serial controller circuitry must implement a method to generate or detect unique device addresses. General purpose computing device serial ports are not able to do this.

Security monitoring circuits detect intrusion into an EGM by monitoring security switches attached to access doors in the EGM cabinet. Access violations result in suspension of game play and can trigger additional security operations to preserve the current state of game play. These circuits also function when power is off by use of a battery backup. In power-off operation, these circuits continue to monitor the access doors of the EGM. When power is restored, the EGM can determine whether any security violations occurred while power was off, e.g., via software for reading status registers. This can trigger event log entries and further data authentication operations by the EGM software.

Trusted memory devices and/or trusted memory sources are included in an EGM to ensure the authenticity of the software that may be stored on less secure memory subsystems, such as mass storage devices. Trusted memory devices and controlling circuitry are typically designed to not enable modification of the code and data stored in the memory device while the memory device is installed in the EGM. The code and data stored in these devices may include authentication algorithms, random number generators, authentication keys, operating system kernels, etc. The purpose of these trusted memory devices is to provide gaming regulatory authorities a root trusted authority within the computing environment of the EGM that can be tracked and verified as original. This may be accomplished via removal of the trusted memory device from the EGM computer and verification of the secure memory device contents is a separate third party verification device. Once the trusted memory device is verified as authentic, and based on the approval of the verification algorithms included in the trusted device, the EGM is enabled to verify the authenticity of additional code and data that may be located in the gaming computer assembly, such as code and data stored on hard disk drives. Examples of trusted memory devices are described in U.S. Pat. No. 6,685,567, entitled "Process Verification."

In at least one embodiment, at least a portion of the trusted memory devices/sources may correspond to memory that cannot easily be altered (e.g., "unalterable memory") such as EPROMS, PROMS, Bios, Extended Bios, and/or other memory sources that are able to be configured, verified, and/or authenticated (e.g., for authenticity) in a secure and controlled manner.

According to one embodiment, when a trusted information source is in communication with a remote device via a network, the remote device may employ a verification scheme to verify the identity of the trusted information source. For example, the trusted information source and the remote device may exchange information using public and private encryption keys to verify each other's identities. In another embodiment, the remote device and the trusted information source may engage in methods using zero knowledge proofs to authenticate each of their respective identities.

EGMs storing trusted information may utilize apparatuses or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected. Examples of trusted memory devices/sources are described in U.S. Pat. No. 7,515,718, entitled "Secured Virtual Network in a Gaming Environment."

Mass storage devices used in a general purpose computing devices typically enable code and data to be read from and written to the mass storage device. In a gaming environment, modification of the gaming code stored on a mass storage device is strictly controlled and would only be enabled under specific maintenance type events with electronic and physical enablers required. Though this level of security could be provided by software, EGMs that include mass storage devices include hardware level mass storage data protection circuitry that operates at the circuit level to monitor attempts to modify data on the mass storage device and will generate both software and hardware error triggers should a data modification be attempted without the proper electronic and physical enablers being present. Examples of using a mass storage device are described in U.S. Pat. No. 6,149,522, entitled "Method of Authenticating Game Data Sets in an Electronic Casino Gaming System."

Various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A gaming system comprising:

a partially transparent isolating enclosure comprising:

a housing defining an interior space, the housing comprising an access door, a base, a front wall, a first side wall, a back wall, a second side wall, a top, and a plurality of upright supports, wherein the access door, the top, the front wall, the first side wall, and the second side wall are substantially transparent, wherein the access door is part of one of the front wall, the first side wall, and the second side wall, and wherein the access door is lockable and unlockable from outside of the interior space, unlockable from inside the interior space, but not lockable from inside the interior space, a ventilation system connected to the housing of the isolating enclosure, a communication system connected to the housing of the isolating enclosure, and a lighting system connected to the housing of the isolating enclosure; and an electronic gaming machine comprising a housing positionable in the interior space of the isolating enclosure, the electronic gaming machine comprising a display device, a sound producing device, a processor, and a memory device that stores a plurality of instructions, wherein the plurality instructions, when executed by the processor, cause the processor to enable a play of a wagering game by a player in the interior space defined by the housing of the isolating enclosure.

2. The gaming system of claim 1, wherein the isolating enclosure comprises a sound barrier configured to absorb sound waves.

3. The gaming system of claim 1, wherein the isolating enclosure comprises an anti-noise sound generator.

4. The gaming system of claim 1, wherein the ventilation system comprises a first filter configured to filter air that enters the interior space defined by the housing of the isolating enclosure.

5. The gaming system of claim 4, wherein the ventilation system comprises a second filter configured to filter air that exits the housing of the isolating enclosure.

6. The gaming system of claim 1, wherein the ventilation system comprises a filter configured to filter air that exits the housing of the isolating enclosure.

7. A gaming system comprising:

a partially transparent isolating enclosure comprising:

a housing defining an interior space and comprising a base, a front wall, a first side wall, a back wall, a second side wall, a top, a plurality of upright supports, wherein the top, the front wall, the first side wall, and the second side wall are substantially transparent, wherein the housing comprising a substantially transparent access door that is part of one of the front wall, the first side wall, and the second side wall, and wherein the access door is lockable and unlockable from outside of the interior space, unlockable from inside the interior space, but not lockable from inside the interior space, a sound barrier connected to the housing of the isolating enclosure and configured to absorb sound waves, a ventilation system connected to the housing of the isolating enclosure, wherein the ventilation system comprises a first filter configured to filter air that enters the interior space defined by the housing of the isolating enclosure, and wherein the ventilation system comprises a second filter configured to filter air that exits the housing of the isolating enclosure, a communication system connected to the housing of the isolating enclosure, and a lighting system connected to the housing of the isolating enclosure; and an electronic gaming machine comprising a housing positionable in the interior space of the isolating enclosure, the electronic gaming machine comprising a display device, a sound producing device, a processor, and a memory device that stores a plurality of instructions, wherein the plurality instructions, when executed by the processor, cause the processor to enable a play of a wagering game by a player in the interior space defined by the housing of the isolating enclosure.

8. The gaming system of claim 7, wherein the isolating enclosure comprises an anti-noise sound generator.

9. A gaming system isolating enclosure comprising:

a housing defining an interior space, the housing comprising a base, a front wall, a first side wall, a back wall, a second side wall, a top, a plurality of upright supports, wherein the top, the front wall, the first side wall, and the second side wall are substantially transparent, wherein one of the front wall, the first side wall, and the second side wall comprise a substantially transparent access door that is lockable and unlockable from outside of the interior space, unlockable from inside the interior space, but not lockable from inside the interior space, wherein the interior space is configured and sized such that an electronic gaming machine and a chair can be positioned in the interior space defined by the housing, the electronic gaming machine comprising a display device, a sound producing device, a processor, and a memory device that stores a plurality of instructions, wherein the plurality instructions, when executed by the processor, cause the processor to enable a play of a wagering game by a player in the interior space defined by the housing;

a ventilation system connected to the housing;

a communication system connected to the housing; and a lighting system connected to the housing.

10. The gaming system isolating enclosure of claim 9, which comprises a sound barrier configured to absorb sound waves.

11. The gaming system isolating enclosure of claim 9, which comprises an anti-noise sound generator.

12. The gaming system isolating enclosure of claim 9, wherein the ventilation system comprises a first filter configured to filter air that enters the interior space defined by the housing, and the ventilation system comprises a second filter configured to filter air that exits the housing.

13. The gaming system isolating enclosure of claim 9, wherein the interior space is configured and sized such that a plurality of electronic gaming machines and a plurality of chairs can be positioned in the interior space.

14. The gaming system isolating enclosure of claim 9, wherein the communication system comprises a player microphone in the interior space defined by the housing.

* * * * *